US006244875B1

(12) United States Patent
McHugh et al.

(10) Patent No.: US 6,244,875 B1
(45) Date of Patent: Jun. 12, 2001

(54) ELECTRICAL CONNECTOR

(75) Inventors: Robert G. McHugh, Evergreen, CO (US); Nick Lin, Hsin-Chuang; Hsing-Yu Yu, Tu-Chen, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/489,345

(22) Filed: Jan. 21, 2000

(51) Int. Cl.[7] ..... H01R 13/62
(52) U.S. Cl. ..... 439/73; 439/331; 439/571
(58) Field of Search ..... 439/70–73, 330, 439/331, 567, 571, 572, 525, 526

(56) References Cited

U.S. PATENT DOCUMENTS 5,163,837 * 11/1992 Hopfer et al. ..... 439/73
5,302,853 * 4/1994 Volz et al. ..... 439/331
5,485,351 * 1/1996 Hopfer et al. ..... 439/73

* cited by examiner

*Primary Examiner*—Gary F. Paumen
(74) *Attorney, Agent, or Firm*—Wei Te Chung

(57) ABSTRACT

A socket connector includes a rectangular base plate adapted to be positioned on a circuit board and retaining an electronic device, such as an integrated circuit, thereon for establishing electrical connection between the electronic device and the circuit board by means of contacts retained therein. Bumps are formed on the base plate for engaging with notches defined in the electronic device to precisely positioning the electronic device with respect to the base plate. A retention module includes a frame having four wall segments defining an interior space therebetween for receiving the base plate. A pair of sideways projections is formed on one wall segment with aligned holes defined therein for receiving pivots of a resilient clip thereby making the clip movable between an open position where the base plate is exposed for receiving the electronic device and a closed position where the clip resiliently engages with the electronic device thereby securing the electronic device to the base plate. A pair of sideways projections is formed on an opposite wall segment each having a barb for engaging an opening defined in a corresponding resilient arm of the clip for fixing the clip at the closed position. Each sideways projection forms a bifurcated board lock for being received in a hole defined in the circuit board. A pin is inserted into a bore defined in each sideways projection to expand the board lock thereby securely fixing the socket connector to the circuit board.

6 Claims, 7 Drawing Sheets

ELECTRICAL CONNECTOR

BACKGROUND OF THE INVENTION

1. Field of the Invention

The present invention generally relates to an electrical connector, and in particular to a socket connector for electrically connecting an electronic device to a printed circuit board.

2. The Prior Art

A variety of socket connectors for mounting an electronic device, such as an integrated circuit module, to a printed circuit board is well known in the art. One of the socket connectors comprises a plate-like body for supporting the electronic device thereon. A plurality of cavities is defined in the socket body for receiving and retaining conductive contacts whereby when the electronic device is loaded on the socket connector, conductive terminals of the electronic device electrically engages corresponding contacts of the socket connector. Raised walls extend along a periphery of and thus surround the socket body defining a recess therebetween for properly positioning and retaining the electronic device on the socket body.

Conventionally, the walls are integrally formed with the socket body as a single unit by means of a molding process. Due to difference in thickness between the walls and the body, warpage often occurs during the molding process. Serious warpage of the socket may lead to poor electrical engagement between the contacts of the socket and the printed circuit board.

It is thus desired to provide a socket connector which is capable to reduce warpage and thus overcomes the above problem.

SUMMARY OF THE INVENTION

Accordingly, an object of the present invention is to provide a socket connector which has reduced warpage during molding process.

Another object of the present invention is to provide a socket connector comprising a plate-like base housing and a retention module separate from each other for facilitating manufacture thereof.

A further object of the present invention is to provide a socket connector having a separate retention module releasably attached to a plate-like body by a clip forming a single device for simplifying the process of mounting the socket connector to a circuit board.

Yet a further object is to provide a socket connector comprising board locks for being tightly fit into corresponding holes defined in a circuit board, each board lock having a bifurcated configuration forming two opposite legs having projections formed thereon extending in exactly opposite directions for facilitating deflection of the bifurcated configuration thereby reducing the force required to mount the connector to a circuit board.

To achieve the above objects, a socket connector in accordance with the present invention comprises a rectangular base plate positioned on a circuit board and retaining an electronic device, such as an integrated circuit, thereon for establishing electrical connection between the electronic device and the circuit board by means of contacts retained therein. Bumps are formed on the base plate for engaging with notches defined in the electronic device to precisely positioning the electronic device with respect to the base plate. A retention module comprises a frame having four wall segments defining an interior space therebetween for receiving the base plate. A pair of sideways projections is formed on one wall segment with aligned holes defined therein for receiving pivots of a resilient clip thereby making the clip movable between an open position where the base plate is exposed for receiving the electronic device and a closed position where the clip resiliently engages with the electronic device thereby securing the electronic device to the base plate. A pair of sideways projections is formed on an opposite wall segment each having a barb for engaging an opening defined in a corresponding resilient arm of the clip for fixing the clip at the closed position. Each sideways projection forms a bifurcated board lock for being received in a hole defined in the circuit board. A pin is inserted into a bore defined in each sideways projection to expand the board lock thereby securely fixing the socket connector to the circuit board.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
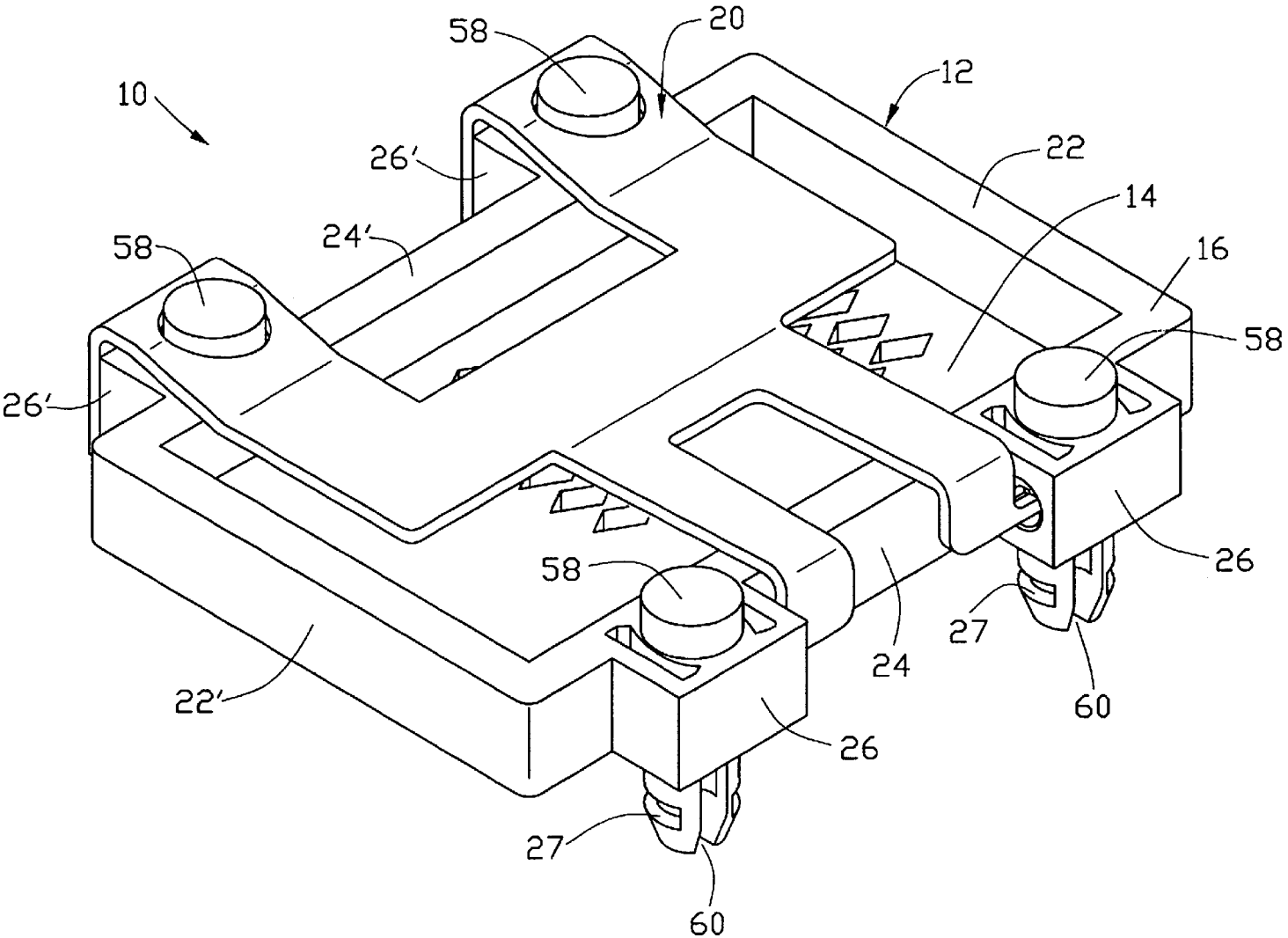
FIG. 1 is a perspective view of a socket connector constructed in accordance with the present invention.
Figure 2:
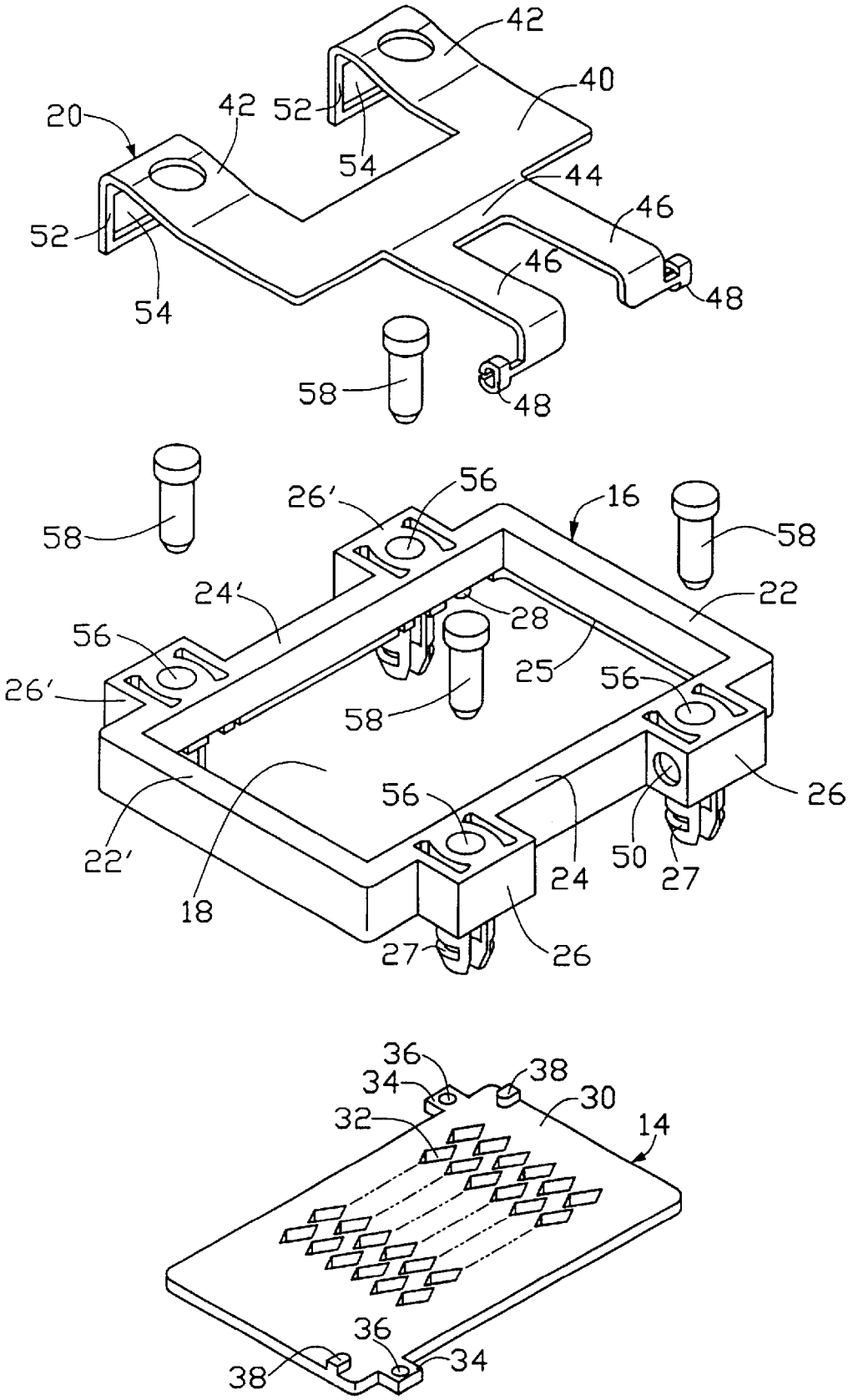
FIG. 2 is an exploded view of the socket connector of the present invention.

Referring to the drawings and in particular to FIGS. 1 and 2, a socket connector 10 constructed in accordance with the present invention comprises a retention module 12 for retaining a plate-like base housing 14 on a circuit board (not shown). The retention module 12 comprises a frame 16 defining an interior space 18 for receiving the base housing 14 therein. In the embodiment illustrated, the frame 16 is rectangular defining a rectangular space 18 for receiving a rectangular base housing 14. The housing 14 is made of an insulative material.

The base housing 14 has a thickness between top and bottom faces thereof smaller than that of the frame 16 whereby a recess is formed therebetween when the base housing 14 is disposed in the frame 16 for accommodating an electronic device, such as an integrated circuit module (not shown). Preferably, the recess has a shape and size corresponding to the electronic device for retaining the electronic device therein. The retention module 12 comprises a resilient clip 20 pivotally attached to the frame 16 and movable between an open position to expose the base housing 14 for receiving the electronic device in the recess and a closed position for resiliently engaging the electronic device thereby applying a retention force to the electronic device to effectively retaining the electronic device in the retention module 12.

By separating the frame 16 from the base housing 14, warpage caused by different thickness during a molding process may be effectively reduced.

Figure 3:
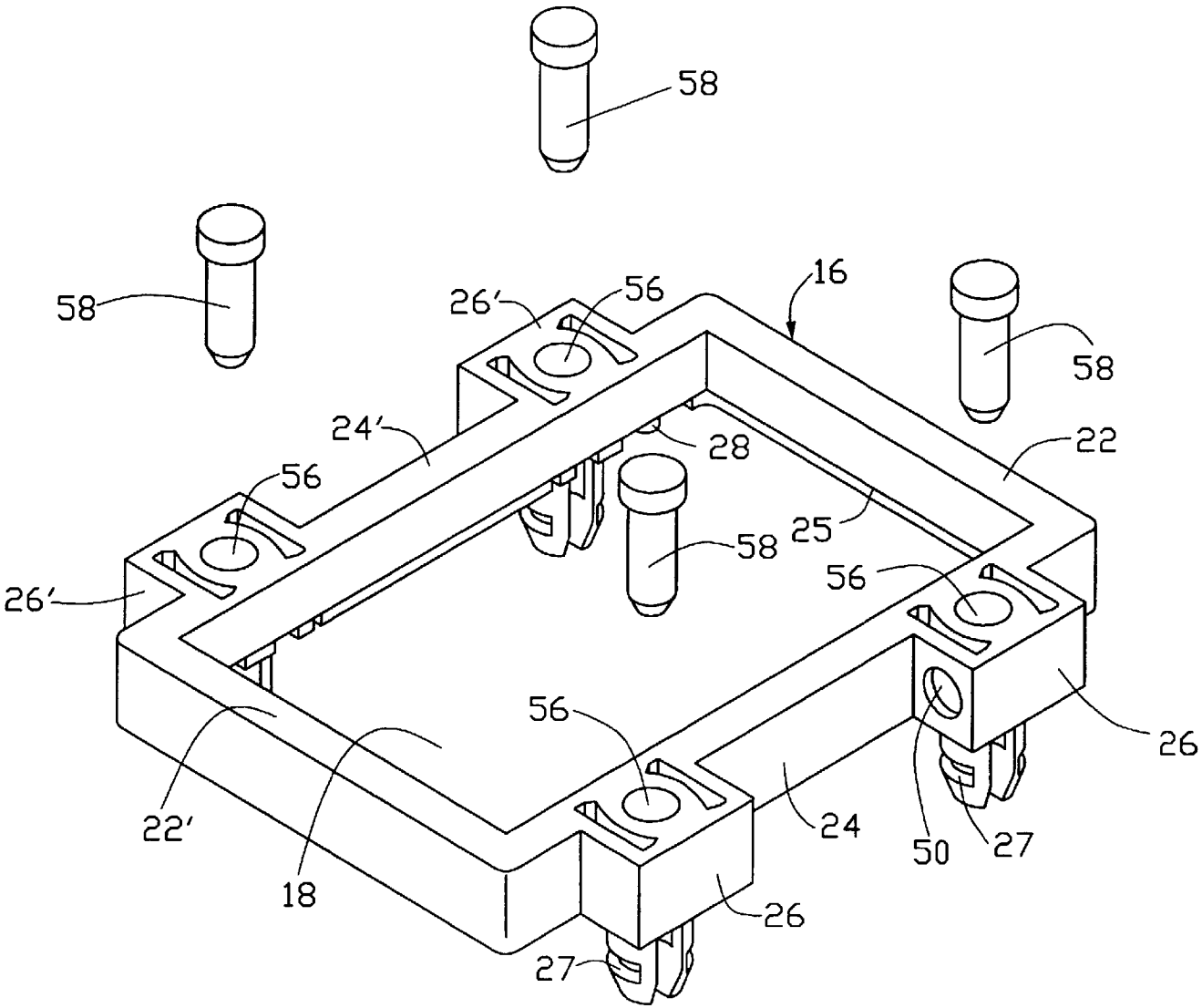
FIG. 3 is a perspective view of a frame of a retention module of the socket connector of the present invention.
Figure 4:
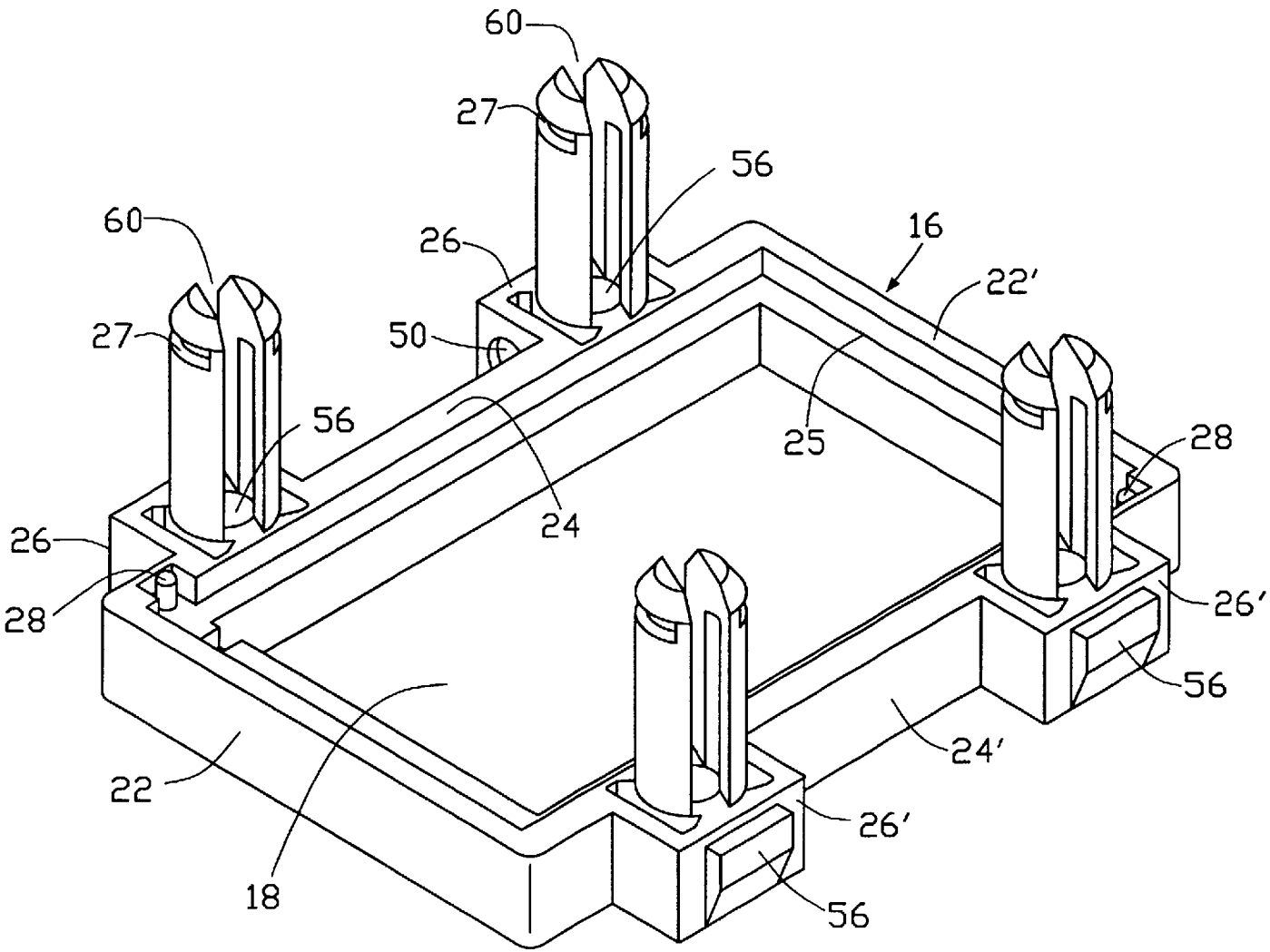
FIG. 4 is another perspective view of the frame.

Also referring to FIGS. 3 and 4, the frame 16 has four wall segments 22, 22' and 24, 24' with the interior space 18 defined therebetween. Two sideways-extending first projections 26 are formed on a first wall segment 24 and two sideways-extending second projections 26' are formed on an opposite second wall segment 24'. The first and second projections 26, 26' extend in opposite directions.

Each projection 26, 26' forms a board lock 27 on a bottom face of the frame 16 for being received in a corresponding hole defined in the circuit board to retain the frame 16 on the circuit board.

Each wall segment 22, 22' forms a step 25 on the bottom face of the frame 16 for forming a space with the circuit board to receive opposite edges of the base housing 14 thereby retaining the base housing 14 in position on the circuit board. If desired, each wall segment 24, 24' may form a similar step for receiving corresponding edges of the base housing 14.

Figure 5:
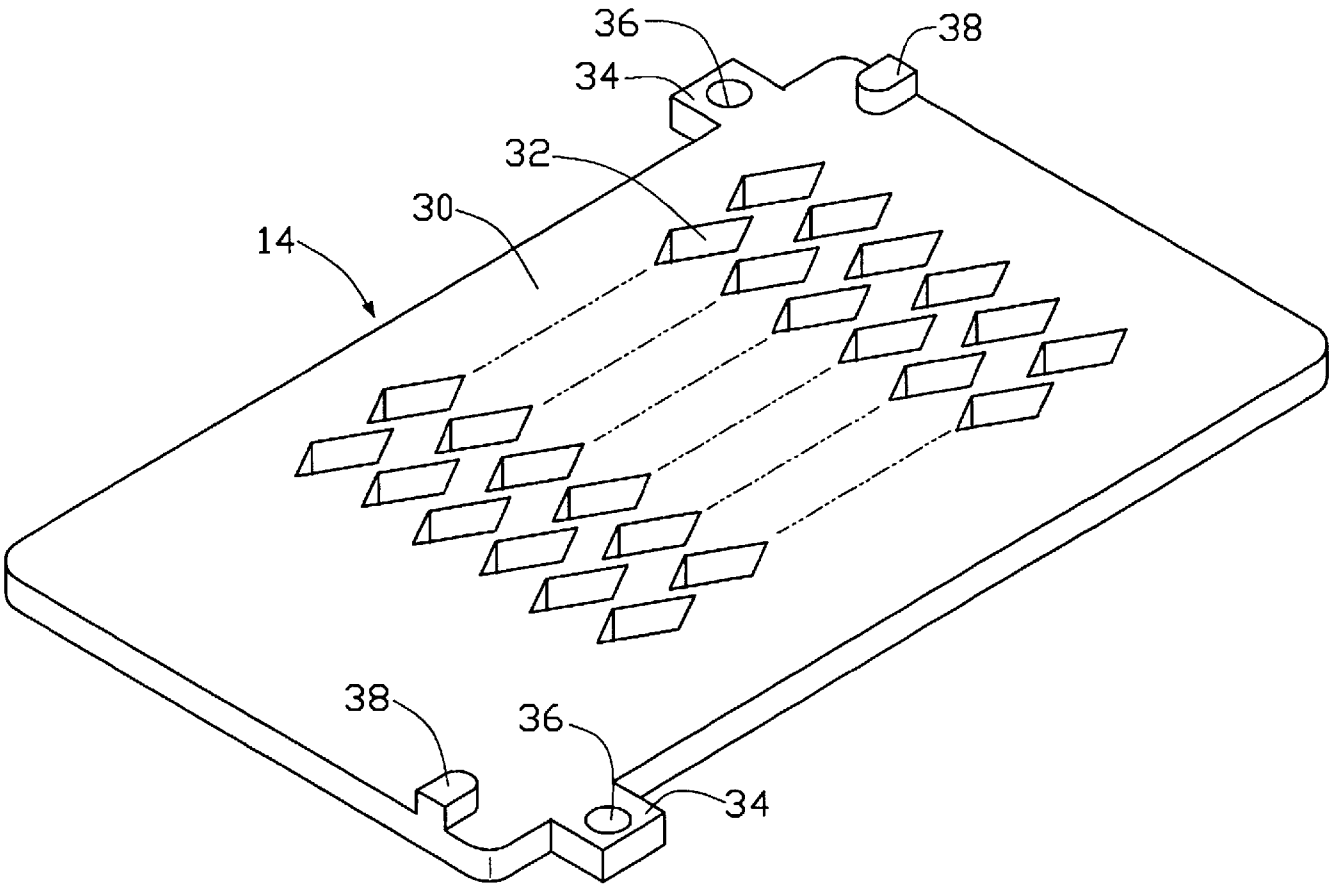
FIG. 5 is a perspective view of a base housing of the socket connector of the present invention.

Also referring to FIG. 5, the base housing 14 comprises a plate-like body 30 in which a plurality of cavities 32 are defined and exposed to top and bottom faces of the base housing 14. Each cavity 32 receives and retains a conductive contact (not shown) therein for electrically engaging with terminal pins of the electronic device and the conductive traces of the circuit board to electrically connect the electronic device tot he circuit board.

Sideways projections 34 are formed on a periphery of the base housing 14 with positioning holes 36 defined therein for receiving positioning posts 28 formed on the bottom face of the frame 16 to properly positioning the frame 16 with respect to the base housing 14. If desired, the posts 28 may be interferentially fit in the holes 36 for retaining the base housing 14 to the frame 16.

In the embodiment illustrated, the steps 25 are configured to receive the projections 34 with the posts 28 formed on the frame 16 at corresponding positions to be received therein.

Raised bumps 38 are formed on the top face of the base housing 14 for engaging with corresponding notches defined in the electronic device thereby precisely positioning the electronic device with respect to the base housing 14. In the embodiment illustrated, the bumps 38 are formed along opposite edges of the base housing 14 that overlap the steps 25 of the frame 16 and extends into the interior space 18 of the frame 6 for engaging with the corresponding notches of the electronic device received in the interior space 18. By using the bumps 38 formed on the base housing 14 to precisely positioning the electronic device with respect to the base housing 14, the frame 16 may not be manufactured with high precision tolerance for properly positioning the CPU module whereby the manufacturing cost thereof may be reduced.

Figure 6:
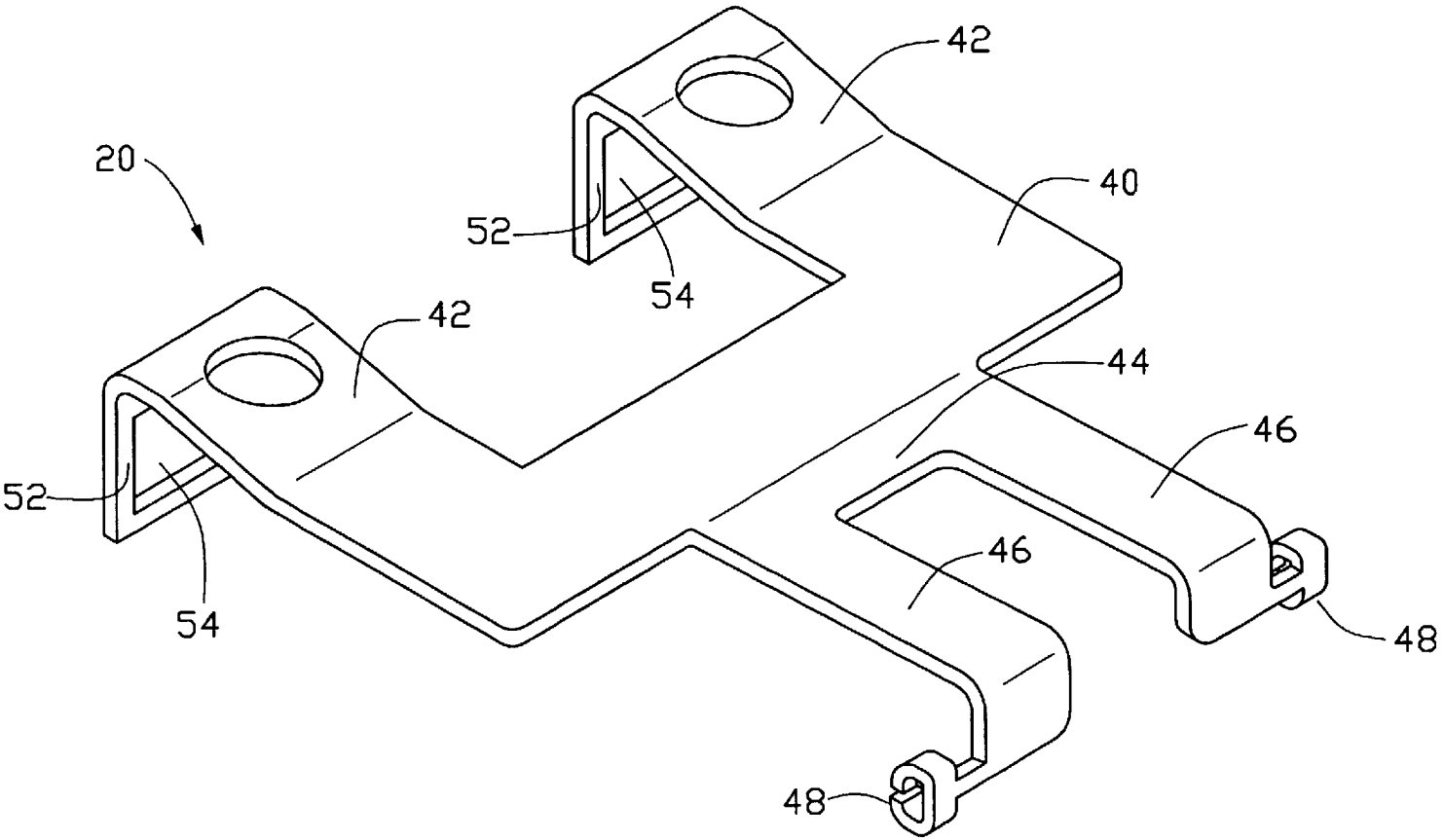
FIG. 6 is a perspective view of a clip of the retention module of the socket connector of the present invention.

Also referring to FIG. 6, the clip 20 comprises a resilient body 40, preferably made of metal or alloy, forming two spaced front arms 42 extending frontward. Each front arm 42 comprises an upward inclined section (not labeled) corresponding to each second projection 26' of the second wall segment 24' and a rear arm 44 extending rearward between the first projections 26 of the first wall segment 24. The rear arm 44 forms two spaced branches 46 having plate-like end portions bent to form trunnions 48 having a substantially cylindrical configuration serving as pivots received in aligned bores 50 defined in the first projections 26 thereby allowing the clip 20 to move between the closed position and the open position. The trunnions 48 are integrally formed with the clip 20 thereby reducing the number of parts required and simplifying assembly of the socket connector 10.

An extension 52 is formed on a free end of each front arm 42 and substantially perpendicular thereto. An opening 54 is defined in each extension 52 for engaging with a wedge-shaped barb 56 formed on the corresponding second projection 26' of the second wall segment 24'. The upward inclination of the front arms 42 causes a resilient force acting upon the electronic device when the openings 54 are forced to engage with the barbs 56. The resilient force acting upon the electronic device facilitates retaining the electronic device in position.

Referring back to FIGS. 3 and 4, a bore 56 is defined in each projection 26, 26' for receiving a pin 58. A slit 60 extends in a diametrically-extending plane through each board lock 27 making the board lock 27 bifurcated comprising two limbs 61. The slit 60 is in communication with the bore 56 whereby the pin 58 received in the bore 56 extends into the slit 60 for expanding the board lock 27. A wedge-shaped barb 62 is formed on each limb 61 for facilitating resiliently contracting the board lock 27 when inserting the board lock 27 into the corresponding hole of the circuit board and securely engaging the circuit board when the board lock 27 is expanded by the insertion of the pin 58.

Figure 8:
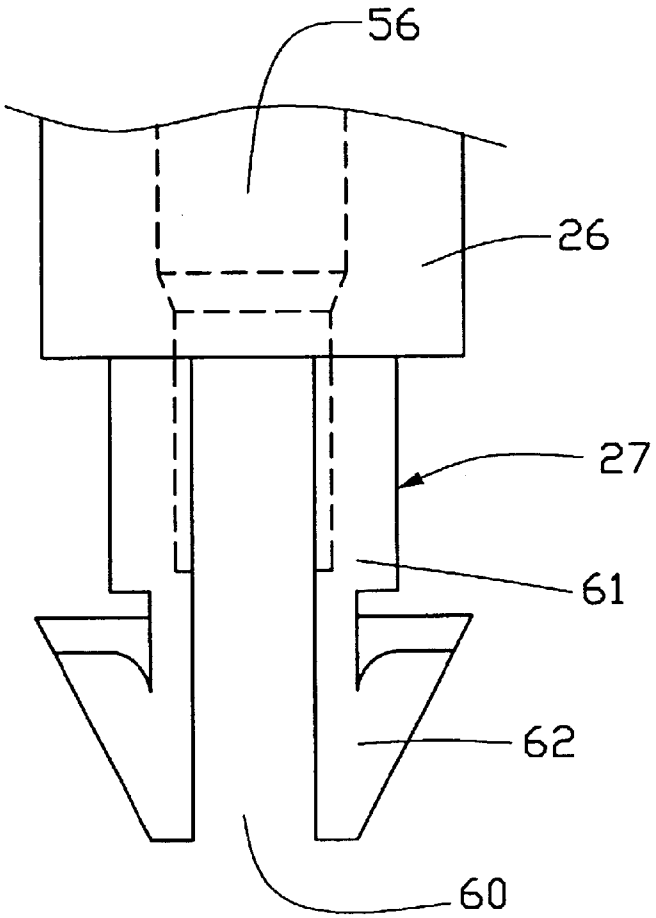
FIG. 8 is another side elevational view of the board lock of FIG. 7.
Figure 7:
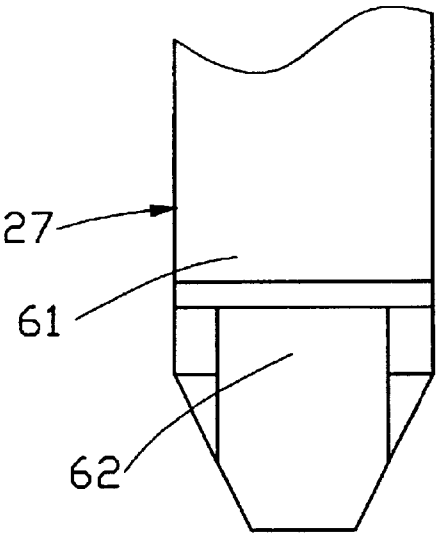
FIG. 7 is a side elevational of a board lock in accordance with another embodiment of the present invention.

Referring to FIGS. 7 and 8 which show another embodiment of the board lock 27 in accordance with the present invention. In the preferred embodiment, the wedge-shaped barbs 62 extend unidirectionally. In other words, the projections 62 only extend in a direction normal to a diametric plane of the slit 60. This facilitates the contraction of the board lock 27 in inserting the board lock 27 into the hole of the circuit board.

Although the present invention has been described with reference to the preferred embodiment, it is apparent to those skilled in the art that a variety of modifications and changes may be made without departing from the scope of the present invention which is intended to be defined by the appended claims.

What is claimed is:

1. A socket connector comprising:

an insulative base plate having a bottom face adapted to be positioned on a circuit board having conductive traces and a top face adapted to support an electronic device having conductive terminals, the base plate defining a plurality of cavities therein for receiving and retaining conductive contacts electrically engaging the conductive traces of the circuit board and the terminals of the electronic device to electrically connect the electronic device to the circuit board, bumps being formed on the top face of the base plate adapted to engage with corresponding notches defined in the electronic device thereby precisely positioning the electronic device with respect to the base plate; and a retention module comprising:

a frame comprising wall segments defining an interior space therebetween for receiving the base plate therein, two first projections being formed on a first wall segment of the frame and defining aligned bores, two second barbs being formed on a second wall segment opposite to the first wall segment; and a resilient clip comprising trunnions pivotally received in the aligned bores for rendering the clip movable with respect to the base plate between an open position where the base plate is exposed for receiving the electronic device and a closed position where the clip resiliently engages the electronic device thereby securing the electronic device on the base plate, the clip comprising two front arms each defining an opening for engaging with the corresponding barb of the second wall segment thereby retaining the clip and the electronic device in position;

wherein the base plate has a first height between the top and bottom faces thereof while the frame has a second height between top and bottom faces thereof greater than the first height whereby a recess is defined therebetween for accommodating the electronic device therein;

wherein a step is formed on the bottom face of at least a pair of opposite walls segments of the frame for defining a space with the circuit board to receive corresponding edge portions of the base plate thereby retaining the base plate in position;

wherein positioning holes are defined in the base plate and wherein positioning posts are formed on the frame for being received in the positioning holes of the base plate to position the frame with respect to the base plate;

wherein the base plate forms a plurality of sideways projections in which the positioning holes are defined, the sideways projections being received in the space defined by the step of the frame, the positioning posts extending from the bottom face of the frame for being received in the positioning holes;

wherein the board locks are formed on a bottom face of the frame adapted to be received in corresponding holes defined in the circuit board;

wherein each board lock has a bifurcated configuration comprising two resilient limbs spaced from each other;

wherein the clip comprises a body portion from which the front arms extend forwardly, a rear arm extending from the body portion rearwardly and having an end section forming the two pivots;

wherein the end section of the rear arm comprises two branches each having a plate portion bent to form a substantially cylindrical configuration serving as a pivot received in the corresponding bore of the frame for pivotally attaching the clip to the frame;

wherein the clip comprises a rear portion having a plate portion bent to form a substantially cylindrical configuration serving as the pivot;

wherein each front arm of the clip comprises an upwardly inclined section.

2. The socket connector as claimed in claim 1, wherein each limb forms a barb, the barbs of the limbs extending in opposite directions for engaging with the corresponding hole of the circuit board.

3. The socket connector as claimed in claim 2, wherein the barbs extend unidirectionally.

4. The socket connector as claimed in claim 1, wherein each board lock is formed on a bottom face of each first projection of the frame, each first projection defining a bore in communication with a space between the limbs of the board lock for receiving a pin which forces the limbs away from each other and thus expands the board lock for securely engaging with the corresponding hole of the circuit board.

5. The socket connector as claimed in claim 1, wherein two second projections are formed on the second wall segment with the barbs formed thereon.

6. The socket connector as claimed in claim 5, wherein a board lock is formed on a bottom face of each of the first and second projections of the frame, each board lock comprising two space limbs and each projection defining a bore in communication with a space between the limbs of the board lock for receiving a pin which forces the limbs away from each other and thus expands the board lock for securely engaging with the corresponding hole of the circuit board.

* * * * *